US006340510B2

(12) United States Patent
Hess et al.

(10) Patent No.: US 6,340,510 B2
(45) **Date of Patent: *Jan. 22, 2002**

(54) THERMALLY PROTECTIVE SLEEVING

(75) Inventors: Joseph P. Hess, West Chester; Janice R. Maiden, Oreland; Joan Bitwinski, Philadelphia, all of PA (US)

(73) Assignee: Federal-Mogul Systems Protection Group, Exton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/309,431

(22) Filed: May 11, 1999

Related U.S. Application Data

(63) Continuation of application No. 08/607,805, filed on Feb. 27, 1996, now Pat. No. 6,045,884.

(51) Int. Cl.[7] ..... F16L 11/02
(52) U.S. Cl. ..... 428/36.1; 428/36.3; 138/123
(58) Field of Search ..... 428/36.1, 36.3; 138/123

(56) References Cited

U.S. PATENT DOCUMENTS

| | | | | |
|---|---|---|---|---|
| 4,015,038 | A | 3/1977 | Romanski et al. | 428/255 |
| 4,282,284 | A | 8/1981 | George | 428/251 |
| 4,425,397 | A | 1/1984 | George | 428/251 |
| 4,764,397 | A | 8/1988 | Fischer et al. | 428/269 |
| 4,800,113 | A | 1/1989 | O'Connor | 428/175 |
| 4,836,080 | A | 6/1989 | Kite, III et al. | 87/9 |
| 4,870,887 | A | 10/1989 | Tresslar et al. | 87/9 |
| 4,909,872 | A | 3/1990 | Jarmon | 156/89 |
| 4,913,937 | A | 4/1990 | Engdahl et al. | 427/314 |
| 4,925,729 | A | 5/1990 | O'Connor | 428/245 |
| 4,949,921 | A | 8/1990 | Jarmon et al. | 244/123 |
| 4,957,962 | A | 9/1990 | Winkler et al. | 524/538 |
| 4,960,629 | A | 10/1990 | Jarmon et al. | 428/113 |
| 5,116,668 | A | 5/1992 | Yamamoto et al. | 428/221 |
| 5,168,006 | A | 12/1992 | Inoguchi et al. | 428/245 |
| 5,177,840 | A | 1/1993 | Laws | 28/220 |
| 5,227,236 | A | 7/1993 | Handermann | 428/361 |
| 5,413,149 | A | 5/1995 | Ford et al. | 138/123 |

FOREIGN PATENT DOCUMENTS

| | | |
|---|---|---|
| DE | 4243465 | 7/1993 |
| DE | 9403391 | 4/1994 |
| FR | 2301617 | 9/1976 |
| WO | WO 95/13495 | 5/1995 |

*Primary Examiner*—Cheryl Juska
(74) *Attorney, Agent, or Firm*—Synnestvedt & Lechner LLP

(57) ABSTRACT

Woven fabric sleeves are comprised of interwoven glass fiber yarns or similar mineral or ceramic fiber yarns, and hybrid yarns or wires utilized as fill yarns. The fill yarns preferably/consist essentially of glass or ceramic fibers with resiliently settable polymeric materials and/or resilient formable wires or combinations thereof. The wires or hybrid yarns are resiliently set to form resilient hoops yieldably imparting to the fabric side edges a tendency to move into adjacent or overlapping relationship. In one form of the method of making a sleeve, the hybrid fill yarns are resiliently set by placing the woven fabric in a folder, applying heat to cause the fill yarns to assume a set in the wrap around or folded condition and then cooling so that the product is resiliently maintained in the set condition. In an alternative method of making the product, the product is woven on a shuttle loom and one or more wires are used as fill yarns. The wires are fed from pretensioned spools. The tension on the spools of wire imparts a resilient set which biases the side edges of the fabric into adjacent and overlapping relationship.

9 Claims, 1 Drawing Sheet

FIG. 1
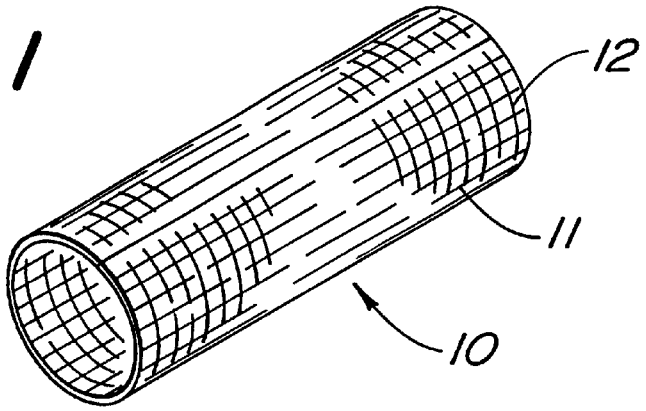
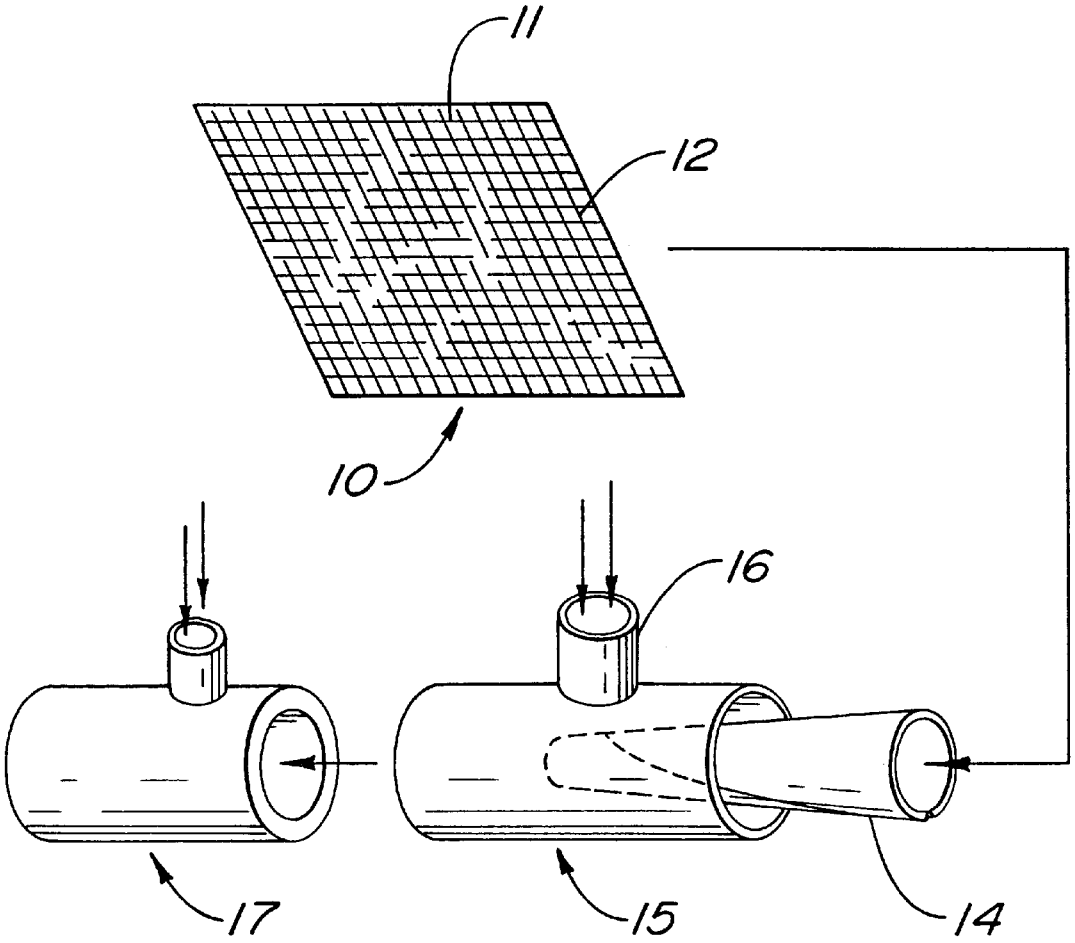
FIG. 2

THERMALLY PROTECTIVE SLEEVING

RELATED APPLICATIONS

This application is a continuation of U.S. application Ser. No. 08/607,805, filed Feb. 27, 1996, and issued as U.S. Pat. No. 6,045,884 on Apr. 4, 2000.

FIELD OF THE INVENTION

This invention relates to tubular fabric products and, more particularly, to fabric sleeving providing thermal protection for elongated objects such as automotive exhaust gas recirculation devices and wiring harnesses.

BACKGROUND OF THE INVENTION

The use of braided or woven fabric sleeves for the protection of cables, hoses and other elongated, flexible articles from the effects of abrasion, high temperatures or the like is well known in the art. Examples selected from a broad spectrum of sleeving products are available from manufacturers such as Bentley-Harris Inc. One such fabric sleeve is a product marketed under the trademark EXPANDO. EXPANDO® sleeving products are lightweight and provide tough physical protection for cable assemblies, wiring harnesses and the like. Many of these products are typically of an open construction, provide abrasion resistance, allow for the circulation of air and prevent the entrapment of moisture. The substrates are neatly maintained in compact form and are protected against abrasion and the possibility of being individually snagged by moving parts of nearby machinery or the like. Other forms of sleeving products are of relatively closed construction and are fabricated of insulating yarns comprised of materials such as glass fiber for the purpose of providing thermal protection.

Some of the products mentioned are longitudinally slit and provided with fastening means so as to allow them to be used in the bundling of elongated objects which previously have been installed and fastened at both ends. One such product is sold under the trademark EXPANDO ZIP. This product is provided with zipper-type fasteners to allow for fastening around the substrate or substrates. Another such product is a braided product having resiliently set filaments extending transversely of the long axis of the product. The resiliently set filaments cause the side edges of a split sleeve to yieldably close, simplifying installation over previously installed elongated devices.

A product of this type is shown and described in U.S. Pat. No. 5,413,149, granted May 9, 1995. Other examples of sleeving products are shown in U.S. Pat. No. 4,870,887, which shows a braided sleeve comprised of materials such as glass fiber and resilient fiber, and U.S. Pat. No. 4,282,284, which discloses the protection of wires or cables by wrapping with a coated and impregnated fabric tape.

SUMMARY AND OBJECTS OF THE INVENTION

Although the above-identified products have proven to be satisfactory for their intended purposes, the need has existed for the use of a thermal wrap product which is easily fabricated, lends itself to the manufacture of products manufactured from closely woven fabrics and is easily installed on products of irregular shape, as well as for installation on elongated parts which have complex curvatures or have been previously installed.

Products of the invention take advantage of the properties of yarns selected from the group of so-called "hybrid yarns"; that is, yarns having more than one material component including, without limitation, over extruded yarns, commingled yarns and DREF process yarns. Especially preferred are yarns of glass or other mineral material combined with a thermoplastic (thermally settable) polymeric material or with wire. The yarns referred to combine the properties of thermal resistance with the capability of having imparted thereto a resilient set. In carrying out the invention, these hybrid yarns are woven into a fabric in which they extend in the fill direction. Thereafter, the hybrid yarns are resiliently set by known means, and the ends of the hybrid yarn form individual hoops with the ends being resiliently urged together and, in some cases, into overlapping relationship with one another.

In carrying out the invention, the hybrid yarns may be resiliently set using techniques described in above mentioned U.S. Pat. No. 5,413,149, which patent is incorporated herein by reference. As used herein and in the '149 patent, the expression "resilient set" or "resiliently set" refers to the incorporation of a permanent set or bias in a resilient filamentary material. Such a resilient set is typically imparted by wrapping a sleeve having filaments capable of being resiliently set on a mandrel and providing the set as by the application of heat while the material is maintained in the wrapped condition. Once set, resiliently set filamentary materials tend to return to the set position in the absence of a restraining counter force.

Still another technique useful for carrying out the present invention involves the use of a bendable resilient yarn or wire, such as served stainless steel in the fill direction. By the application of high tension to the wire or yarn on the spools used during the weaving process, a sleeve exhibits a tendency to wrap around the product as the sleeve is woven. The use of wire has the advantage of increasing the temperature resistance and durability of the product.

Objects of the invention include the production of sleeve materials having an insulating capacity and which are particularly useful for wrapping around irregularly shaped objects, such as exhaust gas recirculation devices.

A further object of the invention is the preparation of sleeves which are well adapted for wrapping around previously installed elongated parts which are connected to other equipment at both ends.

A still further object of the invention is the provision of novel sleeving materials having a high insulating capacity and a resistance to abrasion.

Yet another object of the invention is the provision of sleeving material having a reduced tendency to fabric end fray.

The foregoing and other objects of the invention are achieved by the use of fabric sleeves comprised of interwoven glass or similar mineral or ceramic fiber yarns extended in the warp direction and hybrid yarns extended in the fill direction. Preferably, the hybrid yarns used consist essentially of glass or ceramic fibers together with materials within the group consisting of resiliently settable polymeric materials and resilient formable wires and combinations thereof. The wires or hybrid yarns are resiliently set to form resilient hoops yieldably imparting to the fabric side edges a tendency to move into adjacent or overlapping relationship. In accordance with a further aspect of the invention, a reflective film may be bonded to the inner or outer surface of the sleeve. The glass fiber yarns may be coated with a moisture impervious or high temperature resistant polymeric material.

Methodwise, the invention involves weaving to produce a woven product having glass fiber warp yarns and hybrid fill yarns. In one embodiment of the method of the invention, the hybrid fill yarns are resiliently set by placing the woven fabric in a heated folder, applying heat to cause the fill yarns to assume a set in the wrap around or folded condition and then cooling so that the product is resiliently maintained in the set condition. In accordance with a second embodiment, the product is woven on a shuttle loom and one or more wires are used as fill yarns. The wire is fed from pretensioned spools. Weaving fill wire with tension on the spools of wire has been found to impart a resilient set which biases the side edges of the fabric into adjacent and overlapping relationship.

BRIEF DESCRIPTION OF THE DRAWINGS

FIG. 1 illustrates a sleeve product formed according to the invention; and

FIG. 2 illustrates schematically steps in the manufacture of a sleeve according to the process of the invention.

DETAILED DESCRIPTION OF THE INVENTION

FIG. 1 is a perspective view of an example of a sleeve formed according to the invention. The sleeve, identified by the reference character 10, is preferably woven and is comprised of glass fiber warp yarns 11 and one or more glass/polyester fill yarns 12 formed, for example, by the DREF process. In the illustrative embodiment, the warp yarn is approximately 402 tex. The glass/polyester fill yarn has a glass fiber center core which is wrapped with a non-woven polyester sliver. The polyester ranges from 39% to 66% by weight of the total DREF yarn composition, although polyester to total DREF yarn compositions of from about 20% to about 80% by weight are considered to be suitable for the purpose of the invention. The DREF fill yarn sizes range from 98 to 328 tex. There are approximately 15 to 35 yarns per inch in the warp direction and 10 to 30 fill yarns per inch.

In another form of the invention utilizing a warp yarn identical to the above example, a fill yarn is used which is a glass/polyester DREF yarn with a stainless steel wire of a diameter of between about 0.004 to about 0.006 inches. The wire is combined with a center core glass yarn and wrapped with a non-woven polyester outer sheath utilizing the DREF process.

In the manufacture of products according to the invention, the sleeving material is woven in sheet or tape form and thereafter formed with the selvages in adjacent or overlapping relationship by feeding into a helically extending groove in a slotted folder 14 of known construction located at the entrance of a heating chamber 15. Hot air is supplied to the sleeve through a duct 16 to raise the polymer temperature to a point either above the glass transition temperature or above the softening point. When the shaped product is removed from the heating chamber and cooled within a cooling chamber 17, the polymer recrystallizes or sets the filamentary material in a position in which the selvages are adjacent to or in overlapping relationship and are biased to yieldably remain in that position. Following setting, the sleeve may be passed through a coating bath where a coating of a known saturant, such as an acrylic sold by the Rohm & Haas company under the trademark ExFlex or a water-based epoxy obtainable from Ciba Giegy, is applied in order to seal and give body to the glass fiber warp yarn and to further reduce end fray.

It should also be understood that suitable results are obtainable by clamping the material on a mandrel which is thereafter placed within the heating chamber 16, heated to soften and then cooling to recrystallize or set.

The product of an alternative embodiment of the invention comprises one or more stainless steel fill wires, either in a form in which they are used exclusively or combined with other yarns or filaments. Advantageously, the product may be formed into the shape of a sleeve by weaving on a shuttle loom and by placing the fill yarns under tension for use during the weaving process. This is preferably accomplished by pretensioning the fill wires on the supply spools, which causes the wire to be naturally formed into hoops when tension is released. This, in turn, causes the sleeve to be urged into a substantially cylindrical shape with the side edges abutting or overlapping as the material leaves the loom.

In each example mentioned above, sleeves biased to the closed position and having excellent thermal properties are produced. The sleeves offer excellent thermal protection for elongated substrates already in place and insulate irregular heat sources, such as exhaust gas recirculation devices. The hybrid yarns comprised of glass fibers and polymeric coatings provide thermal protection of the polymeric material and reduced fabric end fray. The served wire provides a product having increased temperature capability where required. Products made according to the invention may be provided with a reflective coating, such as a foil, which can be laminated to the inner or outer surface thereof for increased thermal protection.

What is claimed is:

1. A wrap-around woven fabric sleeve for the protection of elongated substrates, said sleeve comprising warp and fill yarns, the fill yarns being resiliently settable yarns, and the warp yarns being multifilament yarns;

said sleeve having side edges disposed in adjacent relationship;

said fill yarns comprising a hybrid yarn, said hybrid yarn comprising a thermally insulating component and a resiliently settable component consisting essentially of a resiliently settable polymeric material or wire or mixtures thereof; and said resiliently settable component being resiliently set to yieldably maintain the sleeve side edges in adjacent relationship.

2. A wraparound sleeve according to claim 1, wherein the fill yarns comprise resiliently settable wire.

3. A wraparound sleeve according to claim 1, wherein the fill yarns comprise heat settable polymeric material.

4. A wraparound sleeve according to claim 1, wherein a reflective film is bonded to the outer surface of said sleeve.

5. A wraparound sleeve according to claim 1, wherein said sleeve has a moisture impervious coating.

6. A wraparound sleeve according to claim 1, wherein said fill yarn is 98 to 328 tex and comprises glass fiber yarn wrapped with polyester sliver.

7. A wraparound sleeve according to claim 6, wherein the polyester to fill yarn composition is from about 20 to about 80 weight percent.

8. A wraparound sleeve according to claim 1, wherein the fill yarn comprises a center core comprised of a polymeric material and a glass fiber yarn wrapped around said center core.

9. A wraparound sleeve according to claim 1, wherein the said multifilament warp yarns are glass fiber yarns.

* * * * *